US011773663B2

(12) United States Patent
Mallonee et al.

(10) Patent No.: US 11,773,663 B2
(45) Date of Patent: Oct. 3, 2023

(54) MILL SYSTEMS AND METHODS FOR PROCESSING DRILL CUTTINGS

(71) Applicants: Douglas Mallonee, Mobile, AL (US); Bruce Harris, Anchorage, AK (US)

(72) Inventors: Douglas Mallonee, Mobile, AL (US); Bruce Harris, Anchorage, AK (US)

( * ) Notice: Subject to any disclaimer, the term of this patent is extended or adjusted under 35 U.S.C. 154(b) by 97 days.

(21) Appl. No.: 17/377,565

(22) Filed: Jul. 16, 2021

(65) Prior Publication Data

US 2022/0042384 A1 Feb. 10, 2022

Related U.S. Application Data

(63) Continuation of application No. 16/272,753, filed on Feb. 11, 2019, now Pat. No. 11,091,966.

(60) Provisional application No. 62/628,565, filed on Feb. 9, 2018.

(51) Int. Cl.
*E21B 21/06* (2006.01)
*E21B 21/01* (2006.01)

(52) U.S. Cl.
CPC ..... *E21B 21/068* (2013.01); *E21B 21/01* (2013.01); *E21B 21/06* (2013.01)

(58) Field of Classification Search
CPC ..... E21B 21/62; E21B 21/06; E21B 21/01
See application file for complete search history.

(56) References Cited

U.S. PATENT DOCUMENTS

| | | | | |
|---|---|---|---|---|
| 5,303,786 | A | 4/1994 | Prestridge et al. | |
| 6,165,349 | A | 12/2000 | Madar | |
| 7,727,389 | B1 | 6/2010 | Mallonee et al. | |
| 7,731,840 | B1 | 6/2010 | Mallonee et al. | |
| 8,216,459 | B2 | 7/2012 | Mallonee et al. | |
| 2003/0056987 | A1 | 3/2003 | Cordova | |
| 2008/0179090 | A1* | 7/2008 | Eia | E21B 21/066 175/5 |
| 2011/0247804 | A1 | 10/2011 | Woolsey | |
| 2014/0014214 | A1 | 1/2014 | Eia et al. | |
| 2014/0158431 | A1 | 6/2014 | Anderson et al. | |
| 2014/0209392 | A1* | 7/2014 | Jamison | C04B 20/1025 175/217 |
| 2016/0303572 | A1* | 10/2016 | Brace | B02C 13/04 |
| 2017/0335642 | A1* | 11/2017 | Blackwell | E21B 21/066 |

OTHER PUBLICATIONS

8×10 Ft Allis Chalmers Ball Mill, D'Angelo International, LLC, www.dangelointernational.com/product/8-x-10-ft-allis-chalmers-ball-mill/, 3 Pages.

(Continued)

*Primary Examiner* — Cathleen R Hutchins
(74) *Attorney, Agent, or Firm* — Alberto Q. Amatong, Jr.; Amatong McCoy LLC

(57) ABSTRACT

A drill cuttings processing system including a breaker mill. The breaker mill operates to pulverize drill cuttings. The breaker mill includes an outer housing, a drum operatively positioned in the outer housing, hammers operatively positioned in the drum, and a screen configured for discharge of pulverized drill cuttings. A method includes feeding drill cuttings to the breaker mill. The breaker mill is located at a drilling rig site or is attached to a drilling rig. The method includes pulverizing the drill cuttings within the breaker mill.

23 Claims, 9 Drawing Sheets

(56) References Cited

OTHER PUBLICATIONS

BaraCRI Unit Solves Operator's Challenge for Real-Time Cuttings Reinjection, Case Study, 2017, 1 Page, Halliburton.
BaraPhase Thermomechanical Cuttings Cleaner (TCC), 2016, Halliburton, halliburton.com, 2 Pages.
Eliminator I, Dothan Inc., dothaninc.com/products/eliminator-i-2/, 2 Pages.
Hammermill, Product Sheet, Schlumberger, https://www.slb.com/resources/other_resources/product_sheets/miswaco/thermal_desorption_tech.aspx, 2019, 2 Pages.
International Preliminary Report on Patentability issued in PCT Application No. PCT/US2019/017516, dated Aug. 20, 2020; 10 pages.
International Search Report and Written Opinion dated Sep. 20, 2019 (issued in PCT Application No. PCT/US2019/017516) [13 pages].
Offshore TCC Hammermill System, Product Sheet, Mi swaco a Schlumberger Company, 2011, 3 Pages.
Slurry Pumps and Dredge Pumps for High Solids—EDDY Pump OEM, Eddy Pump Corporation, https://eddypump.com/products/slurry-pumps/, 19 Pages.
Solids Control, Cuttings Management & Fluids Processing, Catalog, 2014, Cover Page, Blank Page Company's Statement Page, Overview and Solids Control Systems & Products Page, pp. 3-85, Back Page (88 Pages Total), Version 6, Mi Swaco A Schlumberger Company, U.S.A.
Thermal Desorption Technologies, Brochure, M-I SWACO, 4 Pages.
Thermomechanical Cuttings Cleaner (TCC)—Halliburton, https://www.halliburton.com/en-US/ps/baroid/fluid-services/waste-management-solutions/waste-treatment-and-disposal/thermal-processing-systems/thermomechanical-cuttings-cleaner-tcc.html, 1 Page.

* cited by examiner

MILL SYSTEMS AND METHODS FOR PROCESSING DRILL CUTTINGS

CROSS-REFERENCE TO RELATED APPLICATIONS

The present application is a Continuation of U.S. patent application Ser. No. 16/272,753 filed on Feb. 11, 2019 (now allowed), which claims the benefit of U.S. Provisional Patent Application No. 62/628,565, filed on Feb. 9, 2018. Each of these disclosures is hereby incorporated by reference for all purposes and made a part of the present disclosure.

FIELD

The present disclosure relates to mills and associated apparatus, systems, and methods for processing drill cuttings.

BACKGROUND

Drilling mud exiting oil and/or gas boreholes contains drill cuttings, including rock, metal, and/or other solids. Existing separation techniques for separating drill cuttings from drilling mud require multiple machines (e.g., multiple stages of shale shakers, centrifuges, and/or cyclone separators) to achieve separation of the drill cuttings from the drilling mud, and require transport of the drilling mud and/or drill cuttings (e.g., in trucks) from the drilling site to a remote location for particle size reduction operations (i.e., reducing the particles size of the drill cuttings). In existing operations, such machines for use in particle size reduction of the drill cuttings are not located at the rig site.

BRIEF SUMMARY

One aspect of the present disclosure includes a drill cuttings processing system that includes a mill. The mill includes an inlet positioned to receive drill cuttings from a drilling rig and an outlet positioned to dispense drill cuttings to a reinjection well.

Another aspect of the present disclosure includes a method for reducing the particle size of drill cuttings. The method includes feeding drill cuttings from a drilling rig and into a mill. The mill is located at a drilling rig site or is attached to the drilling rig. The method includes pulverizing the drill cuttings within the mill. The pulverizing of the drill cuttings within the mill reduces the particle size of the drill cuttings.

Another aspect of the present disclosure includes a breaker mill for pulverizing drill cuttings. The breaker mill includes an outer housing, a perforated drum positioned within the outer housing, hammers positioned within the perforated drum, an inlet into the outer housing and the perforated drum, an outlet from the outer housing, and a motor coupled with the perforated drum, the hammers, or combinations thereof. When the motor operates the drum rotates about the hammers, the hammers rotate within the drum, or combinations thereof.

BRIEF DESCRIPTION OF THE DRAWINGS

So that the manner in which the features and advantages of the systems, apparatus, products, and/or methods of the present disclosure may be understood in more detail, a more particular description briefly summarized above may be had by reference to the embodiments thereof which are illustrated in the appended drawings that form a part of this specification. It is to be noted, however, that the drawings illustrate only various exemplary embodiments and are therefore not to be considered limiting of the disclosed concepts as it may include other effective embodiments as well.

Systems, apparatus, products and methods according to present disclosure will now be described more fully with reference to the accompanying drawings, which illustrate various exemplary embodiments. Concepts according to the present disclosure may, however, be embodied in many different forms and should not be construed as being limited by the illustrated embodiments set forth herein. Rather, these embodiments are provided so that this disclosure will be thorough as well as complete and will fully convey the scope of the various concepts to those skilled in the art and the best and preferred modes of practice.

DETAILED DESCRIPTION

Certain aspects of the present disclosure include a mill, such as a breaker mill, for use in reducing the size of drill cuttings within drilling mud exiting a borehole, to systems including such a mill, and to methods of making and using of the same. U.S. Pat. No. 7,727,389 (the '389 patent); U.S. Pat. No. 7,731,840 (the '840 patent); and U.S. Pat. No. 8,216,459 (the '459 patent) provide certain background information relevant to the present disclosure. Accordingly, the disclosures of the '389 patent, the '840 patent, and the '459 patent are hereby incorporated by reference and made a part of the present disclosure, but only to the extent that incorporated subject matter provides background information and/or exemplary composites and processes suitable for use on, or with, the present systems, apparatus and methods. Thus, the incorporated subject matter of the '389 patent, the '840 patent, and the '459 patent shall not serve to limit the scope of the present disclosure. For example, and without limitation, in some aspects the mill and methods of use disclosed herein may be incorporated into the systems and methods disclosed in one or more of the '389 patent, the '840 patent, and the '459 patent.

Drill Cuttings

Figure 1:
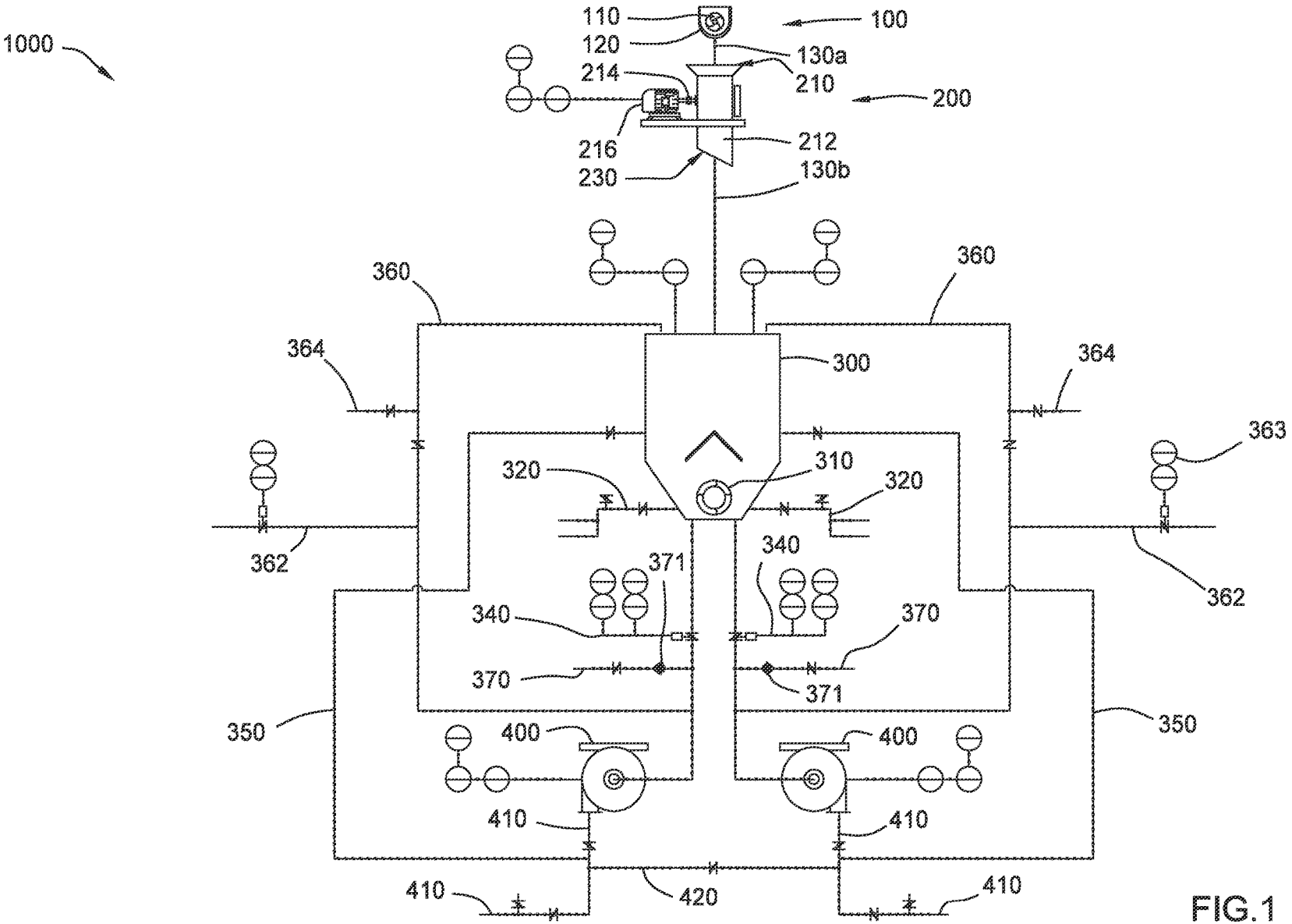
FIG. 1 depicts a schematic of a drill cutting processing system in accordance with certain aspects of the present disclosure.

With reference to FIG. 1, drill cuttings processing system 1000 is depicted. Drill cuttings processing system 1000 includes drill cuttings feeder 100. Drill cuttings feeder 100 includes auger 110 engaged within auger trough 120. Drill cuttings feeder 100 is positioned and/or configured to receive drill cuttings from a drilling rig (not shown). Auger 110 rotates within auger trough 120 to transport drill cuttings through auger trough 120 to an output of drill cuttings feeder 100, from which drill cuttings 130 exit drill cuttings feeder 100 for input into mill 200 of drill cuttings processing system 1000. While drill cuttings feeder 100 is shown and described as including auger 110 operatively engaged within auger trough 120, one skilled in the art would understand that drill cuttings feeder 100 may any other system or apparatus configured and arranged to receive drill cuttings from a drilling rig and feed the drill cuttings to mill 200. Furthermore, one skilled in the art would understand that, in some aspects, drill cuttings feeder 100 may be eliminated, such that drill cuttings are fed directly from drilling rig into mill 200.

Drill cuttings 130 may include, but are not limited to, rock from downhole of the drilling rig that have been broken up by the drilling bit, soil, hydrocarbons, metal, drilling fluids, water, sand, or combinations thereof.

Mill

Figure 2:
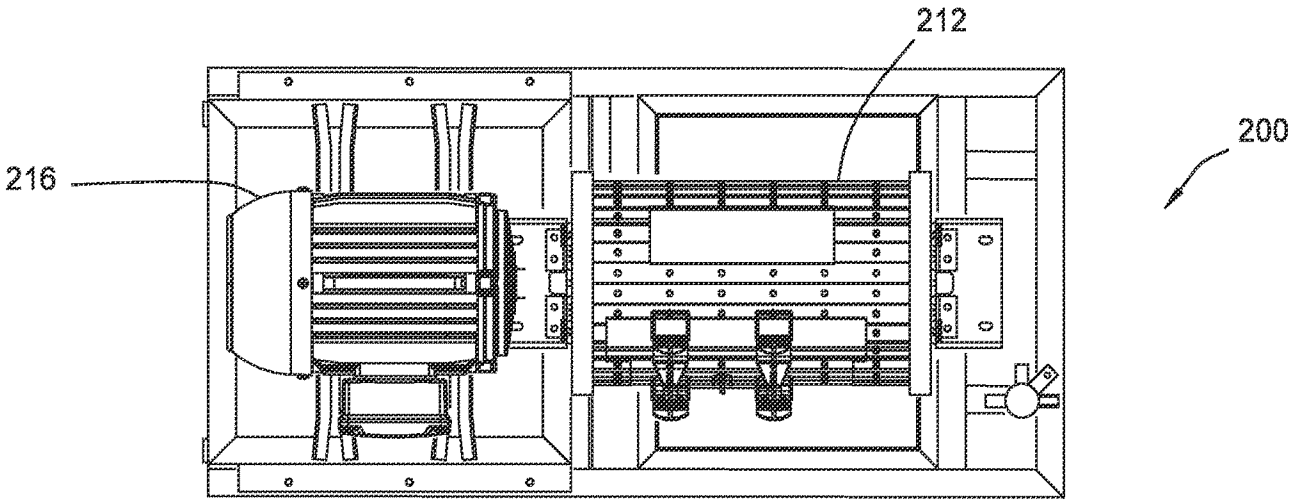
FIG. 2 is a plan view of a mill.
Figure 3:
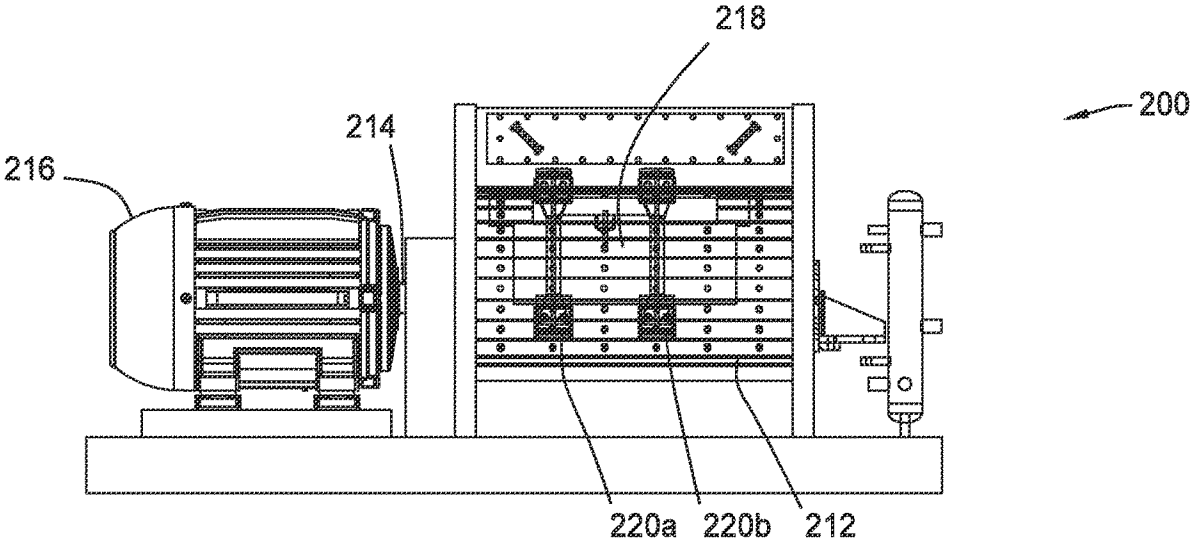
FIG. 3 is an elevation view of a mill.

Drill cuttings 130 are input into mill 200 at cuttings inlet 210. With reference to FIGS. 1-3, mill 200 may be a breaker hammer mill, also referred to as a hammer mill or a breaker mill. In other embodiments, mill 200 is a ball mill, an impact mill, or any other particle reduction device. Within mill 200, drill cuttings 130 are processed to reduce the particle size of drill cuttings 130. In some aspects, the particle size (e.g., diameter) of drill cuttings 130 are reduced by from 1% to 99.9% (i.e., a drill cutting particle having a particle size of 0.5 inches may be processed within mill 200 to have a reduced particle size of from 0.495 inches (1% reduction) to 0.0005 inches (99.9% reduction). In some aspects, the particle size (e.g., diameter) of drill cuttings 130 are reduced by from 10% to 99.9%, or from 20% to 99.9%, or from 30% to 99.9%, or from 40% to 99.9%, or from 50% to 99.9%, or from 60% to 99.9%, or from 70% to 99.9%, or from 80% to 99.9%, or from 90% to 99.9%, or from 95% to 99.9%. The degree of reduction in size of the drill cuttings 130 may be adjusted by adjusting the perforation size of the screen of mill 200, and/or adjusting the spacing between hammers 222 and the inner surface of drum 211 (shown in FIGS. 6A-6D) of mill 200.

With reference to FIGS. 1-3 and 6A-6D, mill 200 includes access door 218 with hinges 220*a* and locks 220*b*. Mill 200 includes outer housing 212 within which drum 211 is positioned and/or arranged. Within drum 211, hammers 222 (or blades or plates) are positioned and/or arranged. In operation, hammers 222 impact drill cuttings 130 within drum 211, causing drill cuttings 130 to be crushed into smaller pieces by repeated blows of hammers 222. Rotating shaft 214 rotates hammers 222 and or drum 211. In some aspects, hammers 222 are mounted within the internal cavity of drum 211. Shaft 214 may be engaged with motor 216. Motor 216 may operate to rotate shaft 214, and shaft 214 may operate to rotate hammers 222. Hammers 222 may be engaged within drum 211, such as on a rotor (e.g., an extension of shaft 214 within the internal cavity of drum 211) such that hammers 221 are free to swing within drum 211. In operation, shaft 214 rotates while drill cuttings 130 are fed into drum 211, causing drill cuttings 130 to be impacted by hammers 222, crushing drill cuttings 130. The outer surface of drum 211 may be a perforated surface or screen. Once drill cuttings 130 are crushed sufficiently to fit through the perforations of drum 211, drill cuttings 130 are expelled through such perforations, and exit mill 200 via mill discharge outlet 230 as reduced drill cuttings 130*b*. As used herein, "reduced drill cuttings 130*b*" refers to drill cuttings have a reduced size (e.g., particle size, such as diameter) relative to drill cuttings 130 prior to processing within mill 200.

Figure 9A:
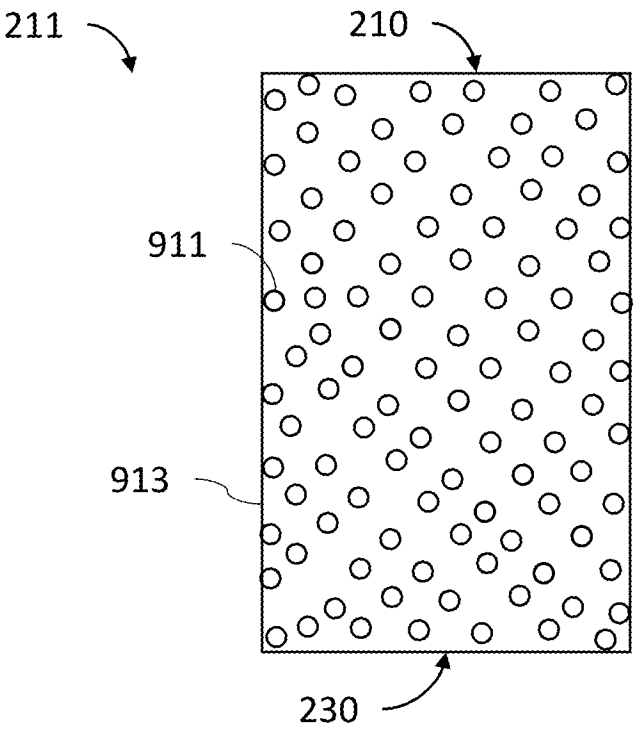
FIGS. 9A-9C are simplified depictions of a perforated drum.
Figure 9B:
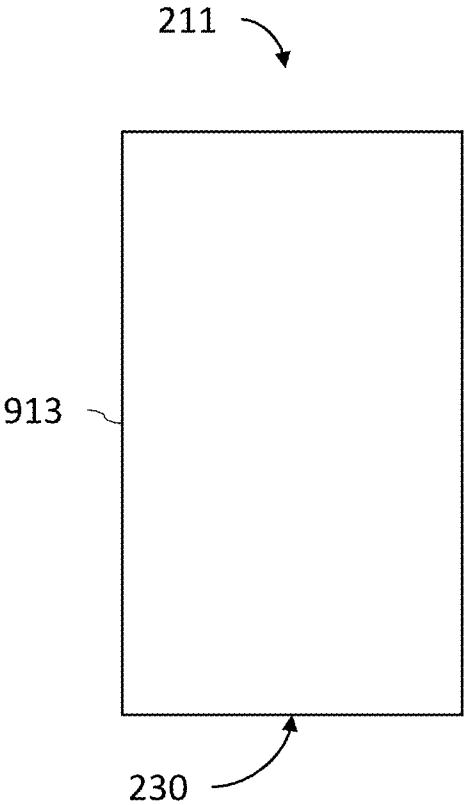
Figure 9C:
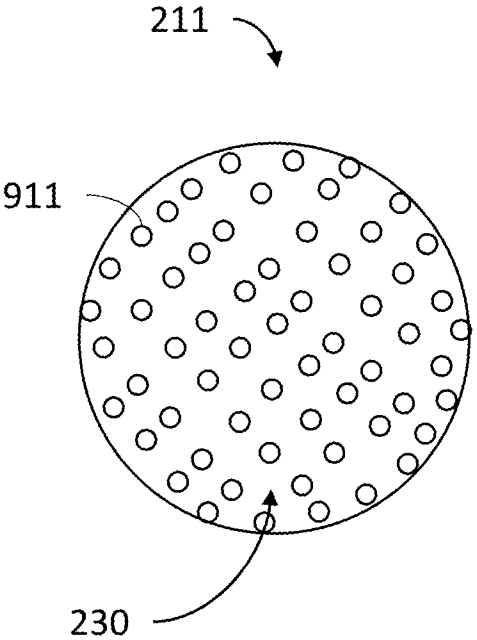

FIGS. 9A-9C depict simplified schematics of a perforated drum 211, including perforations 911. Inlet 210 may be a hole or other opening into the interior of drum 211 that is of sufficient size to allow drill cuttings 130*a* therein. Outlet 230 is defined by perforations 911 through the body of drum 211, such that drill cuttings do not exit drum 211 until sufficiently small to pass through perforations 911. In some aspects, perforations 911 are only on bottom side of drum 211 (i.e., at outlet 230), as shown in FIGS. 9B and 9C. In other aspects, perforations are also on side walls 913 of drum 211, as shown in FIG. 9A.

Mill 200 may include an adjustable screen design to accommodate a specific ranges of particle size reduction. In some aspects, mill 200 includes slide plates for easily changing out the screens of mill (e.g., to increase or decrease the size of reduce drill cuttings 130*b* produced). In some aspects, mill 200 includes quick connect and disconnect mill blades (hammers 222) for easy maintenance thereof.

In some aspects, the drill cuttings 130 are processed by mill 200 of system 1000 in real-time, as the drill cuttings 130 are pumped from downhole, without any intermediate storage and/or transport to a remote location.

FIGS. 2 and 3 depict additional views of mill 200 in accordance with certain aspects of the present disclosure. FIG. 2 is a plan view of mill 200 and FIG. 3 is an elevation view of mill 200. In some aspects, mill 200 is a single-stage mill system. That is, mill 200 reduces the size of drill cuttings 130 to a degree sufficient for drill cuttings 130*b* to be pumped via pumps 400 in a single-stage pass of drill cuttings 130 through mill 200 (i.e., without having to pass drill cuttings 130 through mill 200 multiple times). Mill 200 uses kinetic energy, with high-speed rotating hammers 222 to pulverize and degrade drill cuttings 130 until reduced to less than 1000 μm, less than 500 μm, or less than 300 μm in particle size, for example. In some aspects, drill cuttings 130 input into mill 200 have diameters of up to 4 inches prior to being crushed in mill 200. Mill 200 may operate to continuously degrade and crush solids of drill cuttings 130 for subsequent discharge through openings (perforations) in a solids discharge zone of mill 200 (e.g., outlet 230). Thus, solids received by mill 200 are reduced in size to enable them to be pumped and/or disposed via a dedicated drill cuttings injection well, optionally without requiring additional solids size reduction and optionally without requiring a second pass though mill 200. In some aspects, solids pulverized by mill 200 and pumped by pumps 400 are subsequently subjected to additional particle size reduction prior to disposal and/or reinjection into a dedicated drill cuttings injection well.

In an exemplary embodiment, mill 200 includes thirty-six hammers, has an inlet dimension of 8 by up to 24 inches and an outlet dimension of 15 by 30 inches. One skilled in the art would understand that mill 200 is not limited to this particular size and configuration. Mill 200 may include less than or more than thirty-six hammers, such as from 18 to 60 hammers, or from 20 to 50 hammers, or from 30 to 40 hammers. In certain aspects, drill cutting processing system 1000 includes a control system, such as a programmed logic controller (PLC) for controlling mill 200 and various other portions of system 1000 (e.g., valves and pumps 400).

In some aspects, motor 216 of mill 200 is a 100 HP motor, a variable frequency drive motor, or combinations thereof. Mill 200 may be powered by an electric motor, diesel engine, a hydraulic motor powered by either electric motor or diesel engine, or via any other suitable means. Motor shaft 214 may be equipped with a drive sheave, and motive power may be transmitted through V-belts to drum 211 of mill 200, or, in the case of a hydraulic motor, motive power may be transmitted through a hydraulic motor direct drive to the drum 211 of mill 200.

In certain aspects, mill 200 is constructed and configured for extreme duty, such that mill 200 can handle large amounts of solids feed, as well as abrasive and coarse particles and drill cuttings.

In some aspects, mill 200 has packing glands adapted to provide superior sealing than existing packing glands.

Slurry Tank

Drill cuttings 130*b* exit mill 200 and enter slurry tank 300. Slurry tank 300 includes an agitator for mixing and moving the contents of slurry tank 300 (i.e., drill cuttings 130*b* contained therein), here shown as auger agitator 310 (optionally a variable speed auger). Slurry tank 300 may have one or multiple discharge outlets. As shown, slurry tank 300 includes outlets 320. Outlets 320 may be, for example and without limitation, vacuum truck outlets for optionally dispensing the contents of slurry tank 300 (e.g., drill cuttings 130*b*) into vacuum trucks. Vacuum trucks may be used when, for example, additional suction capacity is required. Slurry tank 300 includes two discharge outlets 330 for discharging the contents of slurry tank 300 (e.g., drill cuttings 130*b*) to pumps 400. Each outlet of slurry tank 300 may be controlled by one or multiple valves, such as vales 340 regulating the flow of drill cuttings 130*b* through discharge outlets 330.

In addition to auger agitator 310, agitation within slurry tank 300 may also be produced via gun lines feeding into slurry tank 300. Slurry tank 300 includes gun lines 350 in fluid communication with pumps 400, downstream of pumps 400, for reintroduction of at least a portion of drill cuttings 130*b* into slurry tank 300. Gun lines 350 operate as mud guns, injecting drill cuttings 130*b*, or a slurry thereof, at a high pressure into slurry tank 300.

Guzzler bleed lines 360 are in fluid commination between discharge outlet lines 330 and slurry tank 300 for optional reintroduction of at least a portion drill cuttings 130*b* into slurry tank 300. Guzzler bleed lines 360 are in fluid communication with guzzler outlet lines 362 for discharge of the contents of guzzler bleed lines 360 into the drilling rig courtyard.

Bring on fluid lines 364 are in fluid communication with guzzler bleed lines 360 for adding additional fluids into guzzler bleed lines 360. Water or air lines 370 are in fluid communication with discharge outlet lines 330 for introduction of water or air into with discharge outlet lines 330. One skilled in the art would understand that slurry tank 300 is not limited to the exact arrangement and configuration, as shown in FIG. 1, and that some inlets, outlets, and lines that are shown may be eliminated, and, also, that additional inlets, outlets, and lines may be added depending on the particular application. Furthermore, one skilled in the art would understand that drill cuttings processing system 1000 is not limited to having slurry tank 300, and that another system or apparatus configured and arranged to receive crushed drill cuttings from mill 200 and feed such drill cuttings to pumps 400 may be used. Furthermore, one skilled in the art would understand that, in some aspects, slurry tank 300 may be eliminated, such that drill cuttings are fed directly from mill 200 to pumps 400.

Pumps

Pumps 400 may be any of a variety of types of discharge pumps for pumping drill cuttings 130*b*. For example, and without limitation, one exemplary pump suitable for use as pumps, in some aspects, is the EDDY™ pump sold by Eddy Pump Corporation of El Cajon, Calif., United States. Pumps 400 may pump drill cuttings 130*b* to a location that is remote from the drilling rig, such as a location that is from about ¼ a mile to about 2 miles from the drilling rig, or any distance therebetween. In some aspects, the discharge outlet lines 410 of pumps 400 are in fluid communication via line 420. Pumps 400 may pump drill cuttings 130*b* to the remote location for storage; additional processing, such as cleaning, separation, or analysis; waste disposal and/or recycling; reinjection into another reinjection well; or combinations thereof. In some aspects, drill cuttings 130*b* are reinjected into a reinjection well without being pumped to a remote location.

In some aspects, the systems and methods disclosed herein utilize pumps 400 capable of pumping the drill cuttings 130 up to one or two miles from the drilling rig, or from ¼ mile to 1.5 miles, or from ½ mile to 1.25 miles, or from ¾ miles to 1 mile, or any distance therebetween.

Mill Injections

Figure 4:
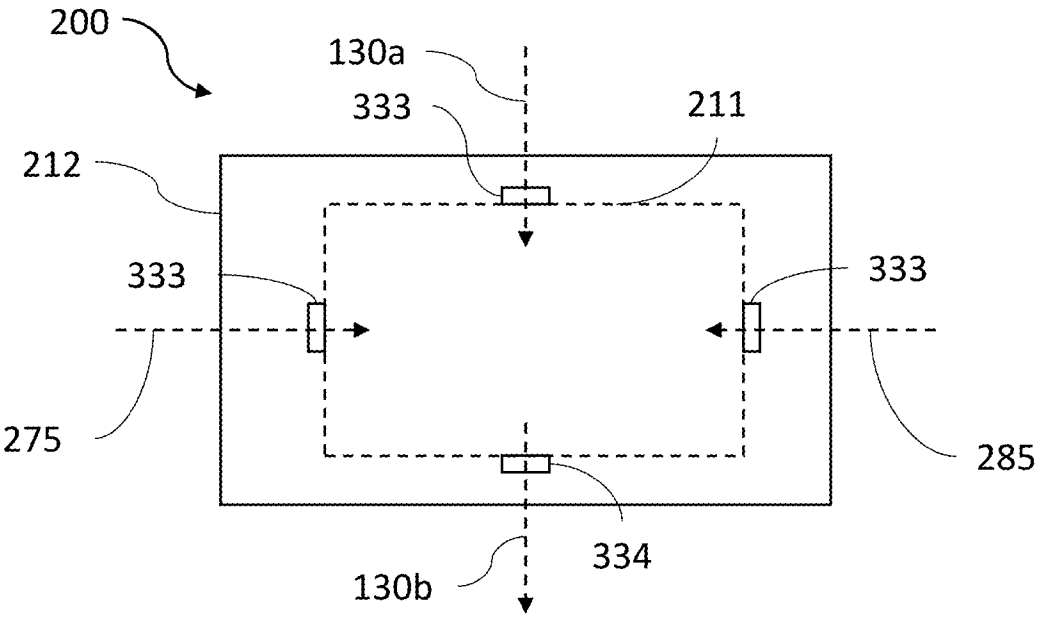
FIG. 4 is a simplified schematic of a mill including injection components.

With reference to FIG. 4, in some aspects drill cuttings 130 are thermally and/or chemically treated. For example, and without limitation, steam 275, chemicals 285, or both may be injected into a portion of system 1000, such as into mill 200, during processing of drill cuttings 130 therein. Steam 275 and/or chemicals 285 may optionally be injected into mill 200 through one or multiple injection ports 333 that feed into the internal cavity of the drum 211 of mill 200. Milled drill cuttings 130*b*, thus, exit mill 200 via ejection port 334 as thermally and/or chemically treated drill cuttings 130*b*. Steam 275 and/or chemicals 285 may assist in, for example, separation and extraction of hydrocarbons from rocks and other solids of drill cuttings 130.

Drum and Hammer Design

Figure 5:
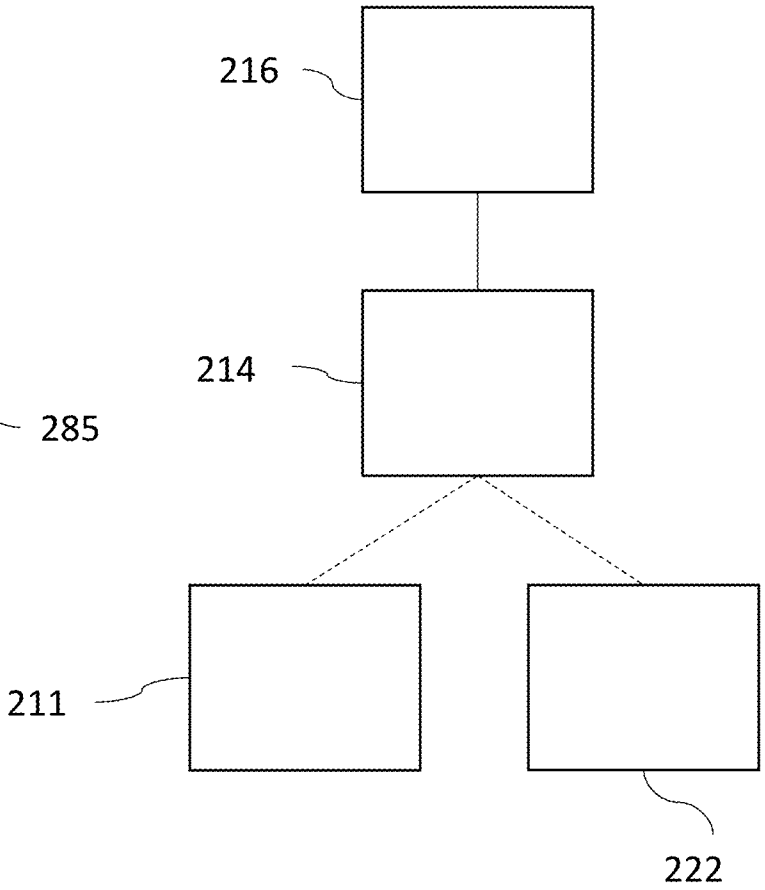
FIG. 5 is a simplified schematic of a mill showing the engagement between moving components thereof.
Figure 6D:
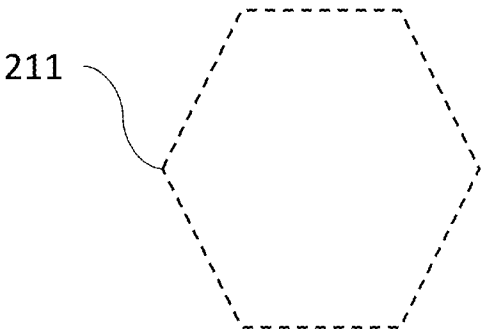
FIGS. 6A-6D depict drums of a mill in accordance with certain aspects of the present disclosure.

FIG. 5 is a schematic showing the arrangement and coupling of some components of the system. Motor 216 is coupled with shaft 214. Shaft 214 is coupled with one or both of drum 211 and hammers 222. As such, in operation motor 216 rotates shaft 214, and shaft 214 rotates one or more of drum 211 and hammers 222. In some aspects, drum 211 of mill 200 has a constant diameter (e.g., a circular profile). In other aspects, drum 211 of mill 200 has a diameter that varies (e.g., non-circular profile). In some aspects, drum 211 of mill 200 has an eccentric circumference. In other aspects, drum 211 of mill 200 does not have an eccentric circumference. FIGS. 6A-6D depict four exemplary drums in accordance with certain aspects of the present disclosure, including a drum 211 having a circular circumference (FIG. 6A), a drum 211 having a dodecagonal circumference (FIG. 6B), a drum 211 having a heptagonal circumference (FIG. 6C), and a drum 211 having a hexagonal circumference (FIG. 6D). The drum 211 of mill 200 is, of course, not limited to these particular shapes, and may have any number of different shapes (e.g., polygonal circumference).

Figure 6A:
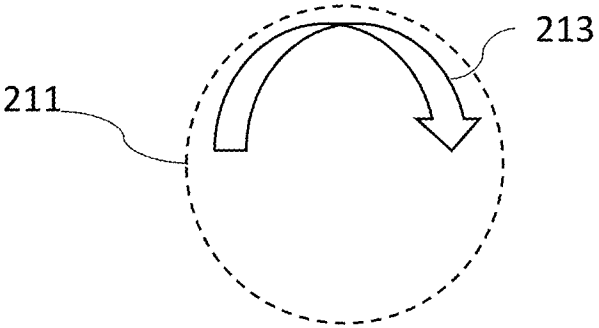
Figure 6C:
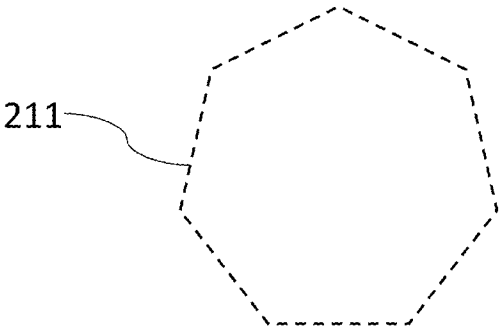
Figure 6B:
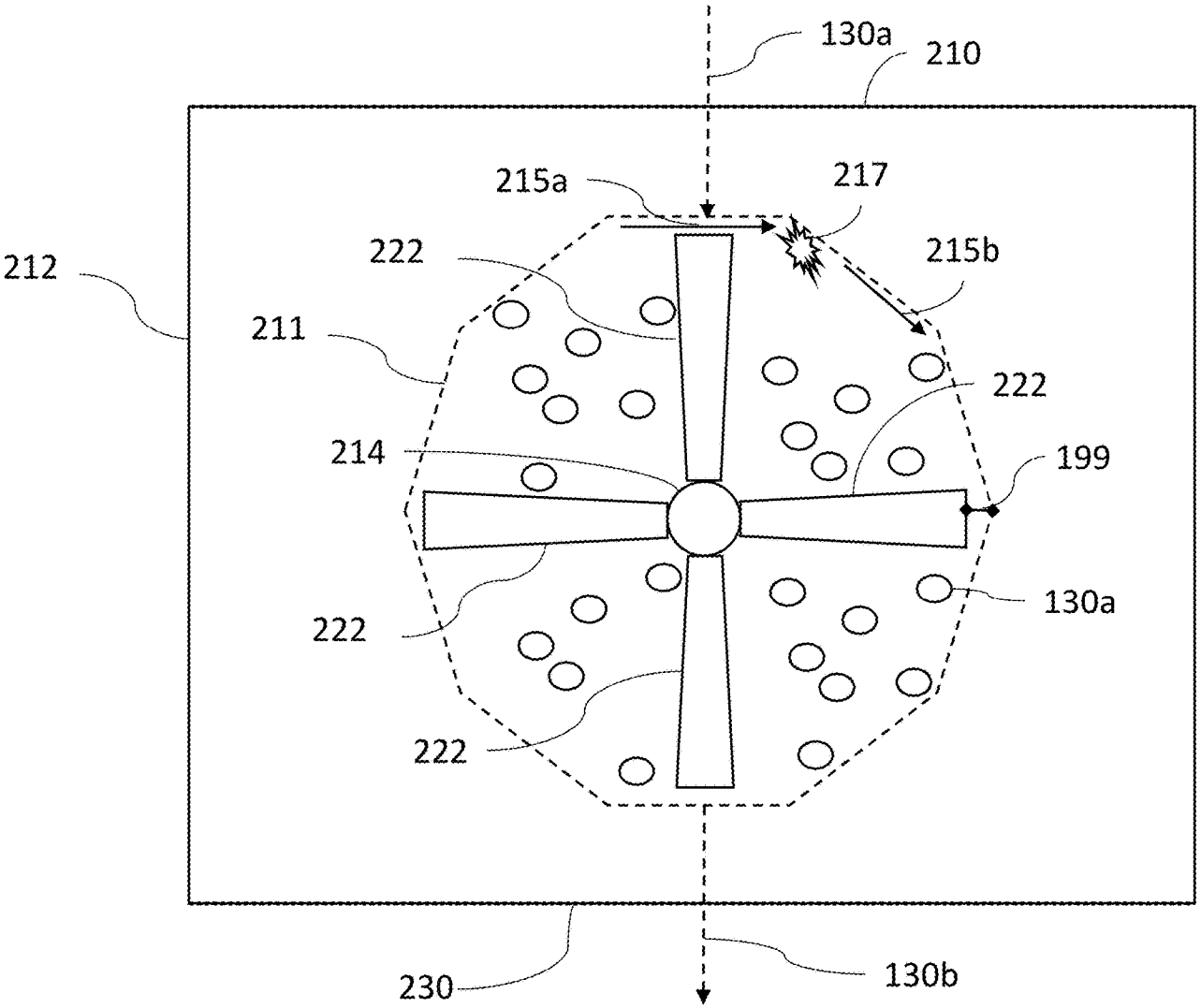

Without being bound by theory, it is believed that an eccentric, non-circular circumference may assist in the efficiency of pulverizing the drill cuttings. For example, as the drill cuttings move within the drum 211 between the hammers and the interior wall of the drum 211, the continuously arcuate surface of a drum 211 having a circular circumference may allow drill cuttings to "ride" along the interior surface of the drum 211 in a continuous arcuate path 213 (FIG. 6A). However, with reference to FIG. 6B, as the drill cuttings move within the drum 211 between hammers 222 and the interior wall of the drum 211, the surface of drum 211 having an eccentric circumference causes the drill cuttings to "ride" along the interior surface of the drum 211 along a first path 215*a* to impact with the interior wall of drum at impact point 217 prior to "riding" along the interior surface of the drum 211 along a second path 215*b*. Such impact points 217 are caused by non-arcuate changes in angles from one portion of the circumference of the drum 211 to another portion of the circumference of the drum 211. Such impacts impart force to the solids, resulting in further pulverization thereof. In operation, as shaft 214 rotates, hammers 222 rotate within drum 211, pulverizing solids contained therein. As the circumference changes, the clearance 199 between the hammers 222 and the interior wall of the drum 211 changes. In some aspects, clearance 199 ranges from 0.25 inches to 2 inches, or from 0.5 inches to 1.5 inches, for example. Once pulverized to a sufficient degree to fit through perforated drum 211, the drill cuttings exit the drum 211 and exit outlet 230, such that drill cuttings are discharged to the slurry tank, as shown in FIG. 1. While FIG. 6B depicts drum 211 having only four hammers 222 operatively coupled to shaft 214, one skilled in the art would understand that drum 211 may have more than four hammers 222, as described elsewhere herein. Also, while only the embodiment shown in FIG. 6B depicts the hammers 222, shaft 214, and outlet 230, one skilled in the art would understand that the embodiments shown in FIGS. 6A, 6C and 6D also includes hammers, shafts, and outlets.

In some aspects, the speed of rotation of the drum 211 and/or hammers 222 may be variable to accommodate for different geological circumstances (e.g., different rock hardness).

In some aspects, hammers 222 of mill 200 may formed of a metal alloy adapted to have a hardness that allows the hammers 222 to crush the drill cuttings, even with a small footprint.

Mill Bypass

Figure 7:
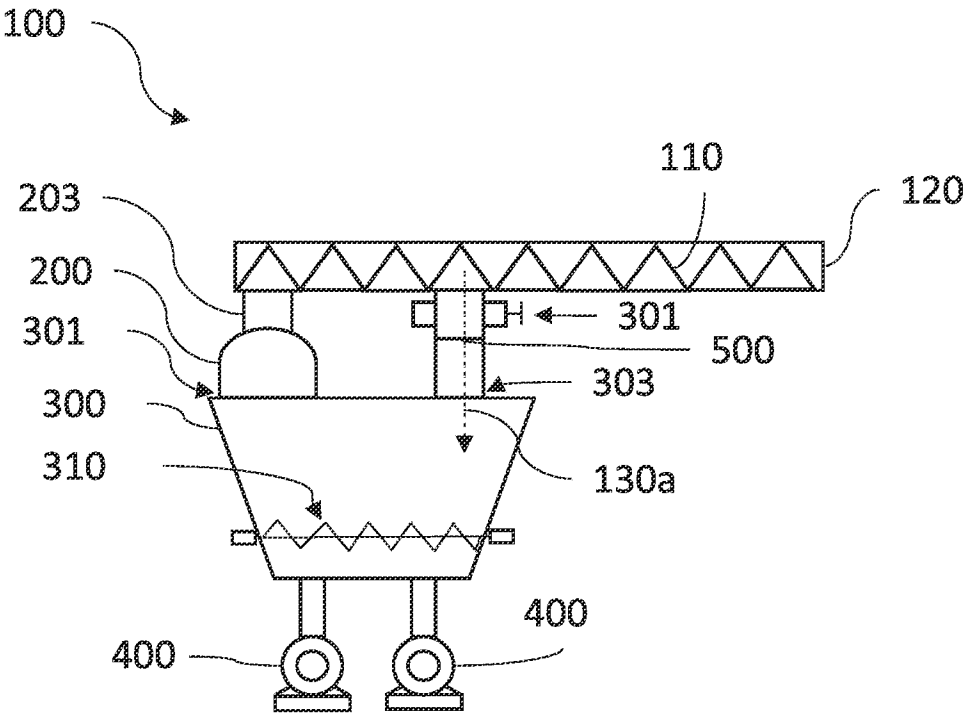
FIG. 7 is a schematic of a portion of drill cutting processing system in accordance with certain aspects of the present disclosure, including a bypass line.

As shown in FIG. 7, in some aspects, drill cuttings 130 may bypass mill 200, travelling through a bypass line 500 into slurry tank 300. Bypass line 500 may allow for continued operation of portions of system 1000 upstream and downstream of mill 200 during, for example, maintenance of mill 200; thereby, reducing downtime of system 1000. In some embodiments, slurry tank 300 is a dual wall tank, and may include first tank inlet 301 for receipt of drill cuttings 130*b* from mill 200 and second tank inlet 303 for receipt of drill cuttings 130 from drill cuttings feeder 100, via bypass line 500. Valve 501 may regulate flow into bypass line 500. In some embodiments, mill 200 is coupled with drill cuttings feeder 100 via rubber boot 203.

Method

Figure 8:
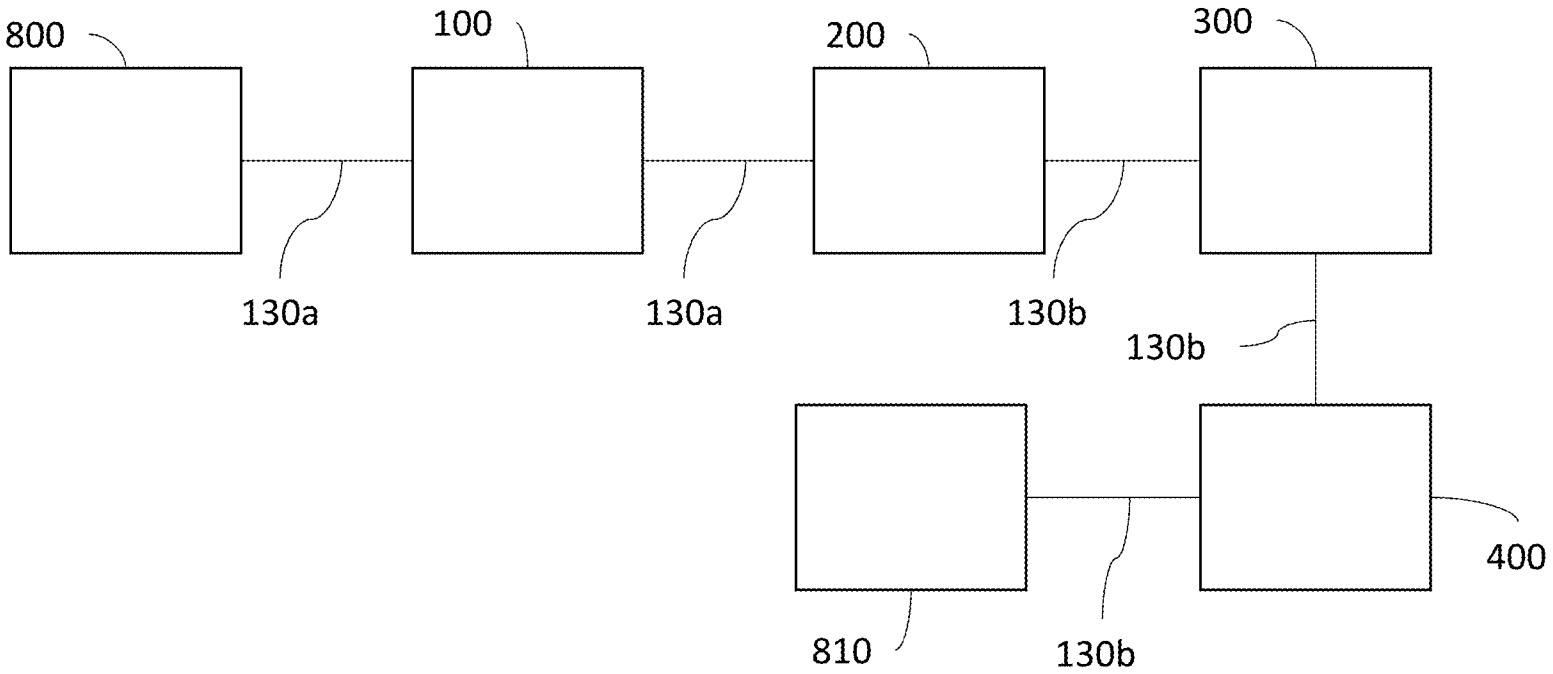
FIG. 8 is a flow chart of a drill cuttings reduction process.

FIG. 8 is a simplified flow chart of a method of processing drill cuttings. The method includes passing drill cuttings 130*a* from drilling rig 800 to drill cuttings feeder 100. From drill cutting feeder 100, the drill cuttings 130*a* are passed to mill 200 and processed to reduced size drill cuttings 130*b*. Drill cuttings 130*b* are passed to slurry tank 300. From slurry tank 300, drill cuttings 130*b* are pumped, via pumps 400, to reinjection well 810.

At the Drilling Rig

The systems and methods disclosed herein allow for cuttings reduction at the drilling rig, rather than at a location remote from the drilling rig. For example, the system 1000, or portions thereof (e.g., mill 200) may be located on or at the drilling rig, or within 100 feet of the drilling rig, or within 100 yards of the drilling rig, or within ¼ of a mile of the drilling rig.

High Production Rates

In certain aspects, the systems and methods disclosed herein that use breaker mills are capable of higher production rates in comparison to systems and methods utilizing ball mills or impact mills to pulverize drill cuttings solids. In some aspects, up to 6 barrels/minute of solids are processed within mill 200, depending on particle size goals.

In some aspects, the systems (e.g., system 1000) disclosed herein do not include a ball mill or impact mill, and the methods disclosed herein include reducing the size of drill cuttings solids without use of a ball mill or impact mill at any stage in the method. In some embodiments, only a breaker mill is used in the systems and methods disclosed herein for reducing the size of drill cuttings solids.

Mobile and Small Footprint

System 1000, or portions thereof, may be mobile (easily transported) and may have a small footprint. In some aspects, mill 200 is an independent mobile system that is transportable for attachment to various drilling rigs at different locations. For example, mill 200 may be on a transportable skid. In some aspects, mill 200 is a stationary system that is attached to a drilling rig. In some aspects, the entire drill cuttings processing system 1000 is an independent mobile system that is transportable for attachment to various drilling rigs at different locations. For example, drill cuttings processing system 1000 may be on one or multiple transportable skids. In some aspects, drill cuttings processing system 1000 is a stationary system that is attached to a drilling rig.

Applications

While the systems and methods disclosed herein are discussed being used at a drilling rig, the systems and methods disclosed herein are not limited to such uses. The systems and methods disclosed herein may be used in oil/gas for cuttings or waste treatment and/or processing; may be used in Gold or other mining industries to process or treat solids processing; and may be used in remediation processes for processing contaminated solids. The systems and methods disclosed herein may be used in any number of applications in which hard, high-abrasive drill cuttings or the like are produced and in need of processing.

In some embodiments the system disclosed herein does not include a rock washer, shale shaker, centrifuge, and/or cyclone separator. In some embodiments the method disclosed herein does not include use of a rock washer, shale shaker, centrifuge, and/or cyclone separator for processing drill cuttings.

Figure 10B:
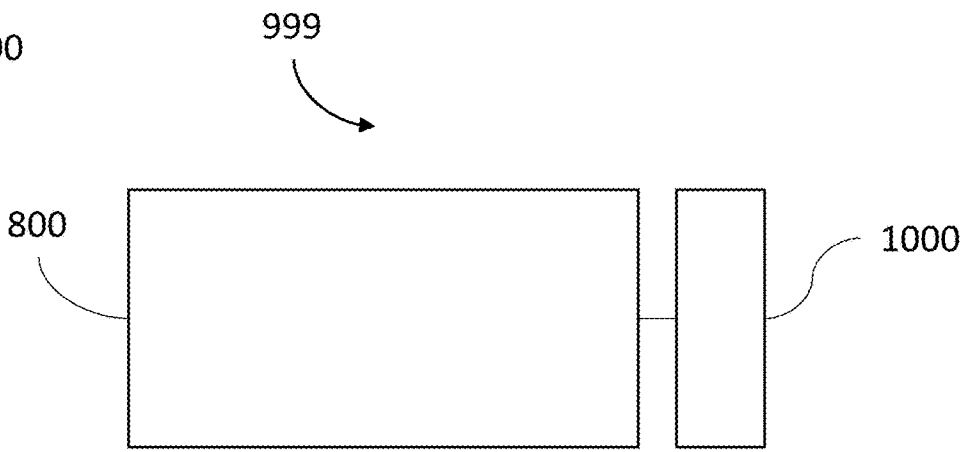
FIGS. 10A and 10B depict simplified schematics of a drill cuttings system attached to a drilling rig at a drill site and arranged relative to a drilling rig at a drill site, respectively.
Figure 10A:
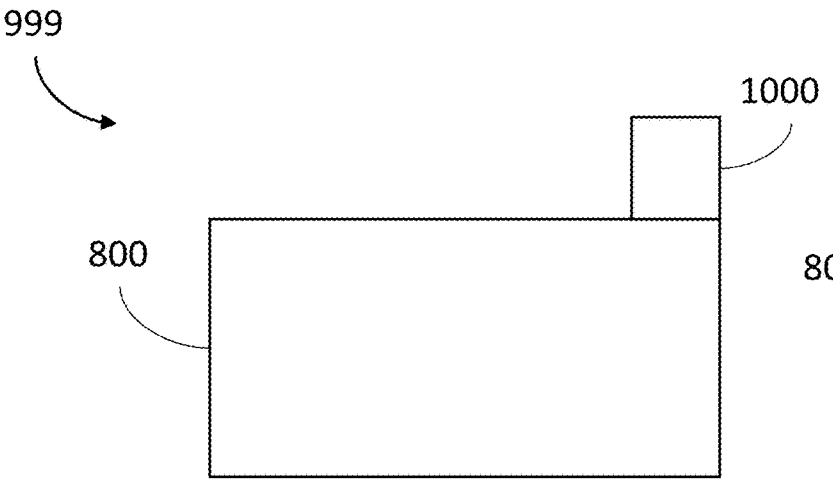

FIGS. 10A and 10B depict simplified schematics of a drill cuttings system 1000 attached to a drilling rig 800 at a drill site 999, and arranged relative to a drilling rig 800 at a drill site 999, respectively.

Other Exemplary Mills

Some other exemplary mills suitable for use as the mill (e.g., mill 200) herein include the Eliminator I available from Dothan Inc. of Semmes, Ala.; the Allis Chalmers ball mill GM768; the HAMMERMILL by Mi SWACO, including the offshore TCC HAMMERMILL; Haliburton Baroid's two-stage hammermill; Haliburton Baroid's Thermomechanical Cuttings Cleaner (TCC) unit; Haliburton's BaraCRI two-stage hammermill modular unit; and other existing mills.

Although the present embodiments and advantages have been described in detail, it should be understood that various changes, substitutions and alterations can be made herein without departing from the spirit and scope of the disclosure. Moreover, the scope of the present application is not intended to be limited to the particular embodiments of the process, machine, manufacture, composition of matter, means, methods and steps described in the specification. As one of ordinary skill in the art will readily appreciate from the disclosure, processes, machines, manufacture, compositions of matter, means, methods, or steps, presently existing or later to be developed that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A system for processing drilling mud at a drilling rig site, the system comprising:

a drilling rig, the drilling rig located at the drilling rig site;

a breaker hammer mill, the breaker hammer mill located at the drilling rig site, wherein the breaker hammer mill comprises a drum having an internal cavity, the drum including:

an inlet positioned to input a drilling mud from the drilling rig into the internal cavity of the drum, wherein the drilling mud contains drill cuttings;

hammers positioned in the internal cavity of the drum, wherein the drum and hammers are movable relative to one another to pulverize the drill cuttings within the internal cavity of the drum;

an outlet positioned to dispense pulverized drill cuttings from the drum;

a steam injection port positioned to inject steam into the internal cavity of the drum for separation and extraction of hydrocarbons from drill cuttings in drilling mud within the drum, a chemical injection port positioned to inject a chemical other than steam into the internal cavity of the drum for separation and extraction of hydrocarbons from drill cuttings in drilling mud within the drum, or combinations thereof.

2. The system of claim 1, wherein the system comprises the steam injection port positioned to inject steam into the internal cavity of the drum.

3. The system of claim 1, wherein the system comprises the chemical injection port positioned to inject the chemical other than steam into the internal cavity of the drum.

4. The system of claim 1, wherein the breaker hammer mill is attached to drill rig.

5. The system of claim 1, further comprising a pump fluidly coupled with the outlet, wherein the pump is configured to pump the pulverized drill cuttings to a reinjection well.

6. The system of claim 1, wherein the drum has a polygonal circumference.

7. The system of claim 1, further comprising a drill cuttings feeder positioned to receive the drilling mud from the drilling rig and to feed the drilling mud into the inlet of the drum, wherein the drill cuttings feeder includes an auger engaged within an auger trough.

8. The system of claim 1, further comprising a slurry tank positioned to receive the pulverized drill cuttings from the outlet of the drum, wherein the slurry tank includes an agitator positioned to agitate the pulverized drill cuttings within the slurry tank.

9. A method for processing drilling mud at a drilling rig site, the method comprising:

positioning a breaker hammer mill at the drilling rig site, wherein the breaker hammer mill comprises a drum having an internal cavity, the drum including an inlet into the internal cavity, hammers positioned in the internal cavity of the drum, and an outlet from the internal cavity of the drum;

feeding a drilling mud from a drilling rig located at the drilling rig site into the internal cavity of the drum;

pulverizing drill cuttings contained within the drilling mud, wherein the pulverizing includes moving the drum and hammers relative to one another such that the drill cuttings are impacted by the hammers within the internal cavity of the drum;

dispensing pulverized drill cuttings through the outlet of the drum; and separating and extracting hydrocarbons from the drill cuttings in the drilling mud within the drum, wherein the separating and extracting comprises injecting steam or a chemical other than steam into the internal cavity of the drum.

10. The method of claim 9, wherein the method comprises injecting the steam into the internal cavity of the drum, wherein the injected steam facilitates the separation and extraction of hydrocarbons within the drilling mud from the drill cuttings.

11. The method of claim 9, wherein the method comprises injecting the chemical other than steam into the internal cavity of the drum, wherein the injected chemical facilitates the separation and extraction of hydrocarbons within the drilling mud from the drill cuttings.

12. The method of claim 9, wherein the pulverizing reduces a particle size of the drill cuttings by from 90% to 99.9%.

13. The method of claim 9, wherein the pulverizing reduces a particle size of the drill cuttings to less than 1000 μm.

14. The method of claim 9, wherein the drum is a perforated drum, and wherein the pulverizing is performed until the drill cuttings have a particle size sufficiently small to pass through perforations of the perforated drum.

15. The method of claim 9, further comprising pumping the pulverized drill cuttings to a remote location, and reinjecting the pulverized drill cuttings into a reinjection well at the remote location, wherein the remote location is located from 0.25 to 2 miles from the breaker hammer mill.

16. The method of claim 15, wherein the drill cuttings are only passed through the breaker hammer mill one time prior to the drill cuttings being pumped to the remote location and reinjected into the reinjection well.

17. The method of claim 9, wherein the drill cuttings are pulverized in real-time, as the drilling mud is pumped from downhole at the drilling rig site, without intermediate storage of the drilling mud and without transport of the drilling mud to a remote location.

18. The method of claim 9, wherein the positioning of the breaker hammer mill at the drilling rig site comprises positioning the breaker hammer mill within 0.25 miles of the drilling rig.

19. The method of claim 9, wherein the positioning of the breaker hammer mill at the drilling rig site comprises attaching the breaker mill to the drilling rig.

20. The method of claim 9, wherein the drill cuttings are processed without use of a ball mill, an impact mill, a rock washer, a shale shaker, a centrifuge separator, or a cyclone separator.

21. The method of claim 9, wherein only the breaker hammer mill is used to reduce a size of the drill cuttings.

22. The method of claim 9, further comprising;

discharging the pulverized drill cuttings from the drum into a slurry tank;

discharging at least a portion of the pulverized drill cuttings from the slurry tank, including pumping at least a portion of the pulverized drill cuttings from the slurry tank into a reinjection well with a pump; and wherein at least a portion of the pulverized drill cuttings discharged from the slurry tank is fed back into the slurry tank.

23. A breaker hammer mill for pulverizing drill cuttings at a drilling site, the breaker hammer mill comprising:

a perforated drum having an internal cavity;

an inlet into the internal cavity;

hammers positioned in the internal cavity of the drum;

an outlet from the internal cavity of the drum;

a motor coupled with the perforated drum, the hammers, or combinations thereof, the motor configured to rotate the drum about the hammers, rotate the hammers within the drum, or combinations thereof; and a steam injection port into the internal cavity for separation and extraction of hydrocarbons from drill cuttings in drilling mud within the drum, a chemical injection port into the internal cavity for separation and extraction of hydrocarbons from drill cuttings in drilling mud within the drum, or combinations thereof.

* * * * *